US011753970B2

(12) United States Patent
Kenyon

(10) Patent No.: US 11,753,970 B2
(45) Date of Patent: Sep. 12, 2023

(54) HYDRAULICALLY-ACTUATED VCT SYSTEM INCLUDING A SPOOL VALVE

(71) Applicant: BorgWarner Inc., Auburn Hills, MI (US)

(72) Inventor: Brian T. Kenyon, McGraw, NY (US)

(73) Assignee: BORGWARNER INC., Auburn Hills, MI (US)

( * ) Notice: Subject to any disclaimer, the term of this patent is extended or adjusted under 35 U.S.C. 154(b) by 0 days.

(21) Appl. No.: 17/465,914

(22) Filed: Sep. 3, 2021

(65) Prior Publication Data

US 2023/0076718 A1 Mar. 9, 2023

(51) Int. Cl.
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 1/3442; F01L 2001/34423; F01L 2001/34426; F01L 2001/3443
See application file for complete search history.

(56) References Cited

U.S. PATENT DOCUMENTS 7,849,825 B2 12/2010 Scheidig et al.
9,695,716 B2 7/2017 Smith et al.
10,662,828 B1 5/2020 Fischer et al.
2008/0135004 A1* 6/2008 Simpson ..... F01L 1/3442 92/120
2019/0234244 A1* 8/2019 Hisaeda ..... F01L 1/022
2019/0323392 A1* 10/2019 Mitsutani ..... F02D 13/0219

* cited by examiner

*Primary Examiner* — Loren C Edwards
(74) *Attorney, Agent, or Firm* — REISING ETHINGTON P.C.

(57) ABSTRACT

A hydraulically-actuated variable camshaft timing (VCT) system comprises a spool valve including a sleeve and a spool, having a plurality of radially-outwardly extending lands, received within a sleeve; a sleeve fluid pathway, extending axially along the sleeve and formed within the sleeve, configured to receive fluid from a fluid supply; an advancing port in the sleeve in fluid communication with an advancing chamber of a hydraulically-actuated camshaft phaser; a retarding port in the sleeve in fluid communication with a retarding chamber of the hydraulically-actuated camshaft phaser; a first fluid supply port formed in the sleeve; a second fluid supply port formed in the sleeve; and an exhaust port axially positioned in the sleeve in between the first fluid supply port and the second fluid supply port or in between the advancing port and the retarding port, wherein the exhaust port is configured to selectively receive fluid from either the advancing chamber or the retarding chamber depending on an axial position of the spool relative to the sleeve.

9 Claims, 9 Drawing Sheets

HYDRAULICALLY-ACTUATED VCT SYSTEM INCLUDING A SPOOL VALVE

The present application relates to fluid control and, more particularly, to linearly-moving valves that control the flow of fluid in a hydraulically-actuated VCT system.

BACKGROUND

Internal Combustion Engines (ICEs) selectively control the flow of fluid in a variety of ways. ICEs can use spool valves that include a sleeve and a spool having lands that slides linearly within the sleeve to selectively permit and stop the flow of fluid, such as engine oil. There are a number of different applications for a spool valve on an ICE, such as controlling the flow of fluid to a hydraulically-actuated variable camshaft timing (VCT) device—often referred to as a camshaft phaser. The spool includes one or more lands, positioned at precise axial locations along the spool, that extend radially-outwardly from an elongated body to engage a radially-inwardly-facing surface of the sleeve forming a fluid-tight seal. As the spool is moved linearly relative to the sleeve, the lands move as well, exposing different fluid pathways to communicate fluid from a source to the exposed fluid pathways. Flow through the fluid pathways can be controlled by moving the lands relative to the sleeve to expose or cover fluid ports in the sleeve that provide access to the fluid pathways. However, location of a fluid supply port relative to fluid exit ports may involve performance challenges. Carefully arranging a fluid supply port relative to a fluid exhaust port can improve the performance of a spool valve.

SUMMARY

In one implementation, a hydraulically-actuated variable camshaft timing (VCT) system includes a spool valve including a sleeve and a spool, having a plurality of radially-outwardly extending lands, received within a sleeve; a sleeve fluid pathway, extending axially along the sleeve and formed within the sleeve, configured to receive fluid from a fluid supply; an advancing port in the sleeve in fluid communication with an advancing chamber of a hydraulically-actuated camshaft phaser; a retarding port in the sleeve in fluid communication with a retarding chamber of the hydraulically-actuated camshaft phaser; a first fluid supply port formed in the sleeve; a second fluid supply port formed in the sleeve; and an exhaust port axially positioned in the sleeve in between the first fluid supply port and the second fluid supply port or in between the advancing port and the retarding port, wherein the exhaust port is configured to selectively receive fluid from either the advancing chamber or the retarding chamber depending on an axial position of the spool relative to the sleeve.

In another implementation, a hydraulically-actuated VCT system includes a spool valve configured to receive fluid from a fluid supply that includes a spool, having a plurality of radially-outwardly extending lands, and a spool cavity, received within a sleeve; an advancing port in the sleeve in fluid communication with an advancing chamber of a hydraulically-actuated camshaft phaser; a retarding port in the sleeve in fluid communication with a retarding chamber of the hydraulically-actuated camshaft phaser; a first fluid supply port formed in the sleeve; a second fluid supply port formed in the sleeve; an exhaust port axially positioned in the sleeve in between the first fluid supply port and the second fluid supply port or in between the advancing port and the retarding port, wherein the exhaust port is configured to selectively receive fluid from either the advancing chamber or the retarding chamber depending on an axial position of the spool relative to the sleeve and, wherein the spool valve directs fluid from the fluid supply to the advancing/retarding chamber, from one of the advancing chamber or retarding chamber to the other of the advancing chamber or retarding chamber, or both.

DETAILED DESCRIPTION

Figure 1A:
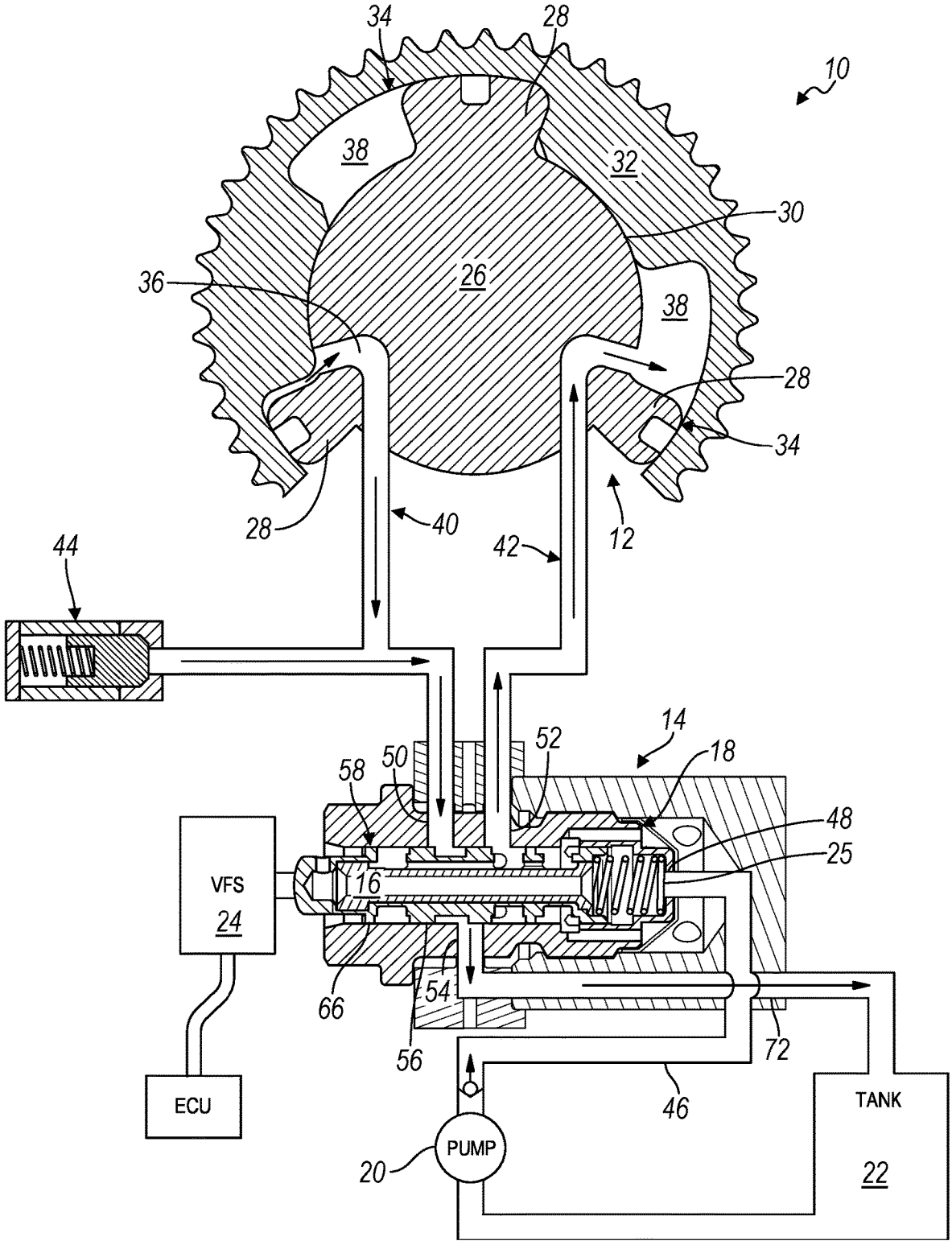
FIG. 1*a* is a schematic view depicting an implementation of a hydraulically-actuated variable camshaft timing (VCT) system.

A hydraulically-actuated VCT system has a spool valve including a spool that slides relative to a sleeve to control the flow of fluid from a plurality of supply ports through a common exhaust port. The spool valve can include the sleeve (or a bolt) that receives fluid from a fluid source and the spool that slides axially within the bolt to control the flow of fluid to and from a VCT device, also referred to as a camshaft phaser. In particular, fluid can be supplied to the bolt from the fluid source and then directed within the bolt into both a first supply port and a second supply port through which fluid can be provided to the VCT device. A fluid exhaust port can be positioned axially along the spool valve at a location that is in between the first and second supply ports. The fluid exhaust port can also be located axially along the spool in between an advancing port and an exhausting port. In one implementation, a fluid manifold within the bolt can communicate fluid to the first supply port and the second supply port formed in the bolt on opposite sides of the fluid exhaust port. In another implementation, the spool valve receives fluid from the fluid supply and directs fluid to the advancing port or the retarding port. At the same time, the spool valve can direct fluid from one of an advancing chamber or retarding chamber to the other of the advancing chamber or retarding chamber. With respect to this implementation, the spool valve can direct fluid from a fluid supply to the advancing/retarding chamber, from one of the advancing chamber or retarding chamber to the other of the advancing chamber or retarding chamber, or both. Such an implementation of a spool valve can use both fluid pressure from a fluid supply and fluid pressure from camshaft torque to facilitate camshaft phasing. In contrast, previous spool valves have used more than one exhaust port to vent fluid from the valve. In hydraulically-actuated VCT systems using both an oil pump and camshaft-torque assistance to provide fluid to the VCT device, previous spool valves having more than one exhaust port can also involve more than one check valve thereby increasing complexity.

One implementation of a hydraulically-actuated variable camshaft timing (VCT) system 10 is shown in FIGS. 1-3. The system includes a hydraulically-actuated camshaft phaser 12, a spool valve 14 having a spool 16 and a sleeve or bolt 18 that receives the spool 16, a pump 20 supplying pressurized fluid to the spool valve 14, and a fluid tank 22 that receives supplies fluid and receives exhaust fluid. The system 10 also includes a variable force solenoid (VFS) 24 that axially moves the spool 16 relative to the sleeve 18 in opposition to a spring 25 to control the flow of fluid within the system 10. The phaser 12 includes a rotor 26 having, in this implementation, a plurality of vanes 28 that extend radially outwardly from a hub 30 and a stator housing 32 that receives the rotor 26. The vanes 28 can extend into fluid chambers 34 formed in the stator housing 32 separating the fluid chambers 34 into an advancing chamber 36 and a retarding chamber 38. An advancing fluid pathway 40 can fluidly communicate with the advancing chamber 36 while a retarding fluid pathway 42 can fluidly communicate with the retarding chamber 36. Flow of fluid into and out of the advancing fluid pathway 40 and the retarding fluid pathway 42 can exert force on the rotor 26 through the vanes 28, selectively rotating or holding the rotor 26 relative to the stator housing 32. An example of a hydraulically-actuated camshaft VCT system is described in application Ser. No. 14/840,683 that ultimately issued as U.S. Pat. No. 9,695,716, the contents of which are hereby incorporated by reference. The hydraulically-actuated VCT system 10 can adjust the camshaft phaser 14 in reaction to fluid under pulsation from camshaft rotation, fluid that is pressurized by the pump 20, or both. One or more check valves can control the flow of fluid under pulsation. The check valves can be implemented in a variety of ways, such as using as ball valves or reed valves.

The rotor 26 can be mechanically attached to a camshaft by a fastener (not shown), such as a bolt, and the camshaft can be installed in the head of an internal combustion engine. A hydraulic lock 44 can be positioned in the stator housing 32 and be biased so that it releasably engages the rotor 26 to maintain a fixed angular position of the rotor 26 relative to the housing 32. The fluid pump 20 supplies pressurized fluid to the spool valve 14 through a fluid supply 46 at an axial end of the spool valve 14. The fluid supply 46 can fluidly communicate with one or more fluid pathways of the spool valve 14. For example, in this implementation, the fluid supply 46 fluidly communicates supply fluid with a fluid supply port 48 that receives fluid from the fluid pump 20. An exhaust port 54 can be axially positioned along the sleeve 18 in between an advancing port 50 and a retarding port 52. The advancing chamber 36 of the phaser 12 can be in fluid communication with the advancing fluid pathway 40 and the advancing port 50 while the retarding chamber 38 can be in fluid communication with the retarding fluid pathway 42 and the retarding port 52. Fluid can flow from the spool valve 14 through the advancing port 50 to the advancing chamber 36 or alternatively flow from the advancing chamber 36 through the advancing port 50 to the exhaust port 54. Similarly, fluid can flow from the spool valve 14 through the retarding port 52 to the retarding chamber 38 or alternatively flow from the retarding chamber 38 through the retarding port 52 to the exhaust port 54.

A spool plug 60 can be received concentrically by the spool 16 within a spool cavity 62. The spool 16 can have a plurality of spool lands 58 that extend radially-outwardly from the plug 60 and can help direct the flow of fluid from the fluid supply 46 to the advancing port 50, the retarding port 52, and the exhaust port 54. In addition, the spool 16 can include one or more check valves 64 that can control the flow of fluid from the advancing chamber 36 to the retarding chamber 38 or from the retarding chamber 38 to the advancing chamber 36, as shown in FIG. 1B. In this implementation, the check valves 64 are reed valves carried by spool plug 60 and opposably biased into engagement with an inner surface 66 of the spool 16. The spool plug 60 can also include a plug cavity 68 within the spool plug 60 to help vent fluid from the spool valve 14. An outer surface of the spool plug 60 can include one or more valve stops 70 that extend radially outwardly from the plug 60 to regulate the travel of a flapper used in reed valves of check valves 64. This will be described below in more detail. Also, this implementation of the spool 16 can be applied to a hydraulically-actuated VCT system that is capable of adjusting the camshaft phaser 14 in reaction to fluid under pulsation in response to camshaft rotation, fluid that is pressurized by the pump 20, or both as discussed above.

The spool 16 of the spool valve 14 is concentrically positioned relative to the sleeve 18 (also referred to as a bolt) and is received within a sleeve cavity 56. The spool 16 includes an elongated body and a plurality of lands 58, located at axial positions along the body, that extend radially outwardly from the body. Radial outer surfaces of the lands 58 have a shape corresponding to an inside surface of the sleeve cavity 56 such that the surfaces of the lands 58 closely match the inside surface to prevent the axial flow of fluid from one side of a land 58 to another side of the land 58. The cross-sectional shape of the spool 16 and lands 58 can be annular or circular or another shape that conforms to an inner surface of the sleeve 18 within the sleeve cavity 56. Both the spool 16 and the lands 58 can be made from one of many different types materials, such as a metal alloy. In this implementation, the fluid supply 46 can fluidly communicate with the advancing chamber 36, the retarding chamber 38, and the exhaust port 54. That is, the exhaust port 54 can fluidly communicate with both the advancing port 50 and the retarding port 52 as well as with a reserve tank of fluid drawn on by the fluid pump 20. The spool 16 includes a spool advancing port 72, a spool retarding port 74, and a spool exhaust port 76. A first check valve 64*a* can releasably engage an inner surface of the spool cavity 62 to control fluid flow through the spool advancing port 72 while a second check valve 64*b* can control fluid flow through the spool retarding port 74.

Figure 1B:
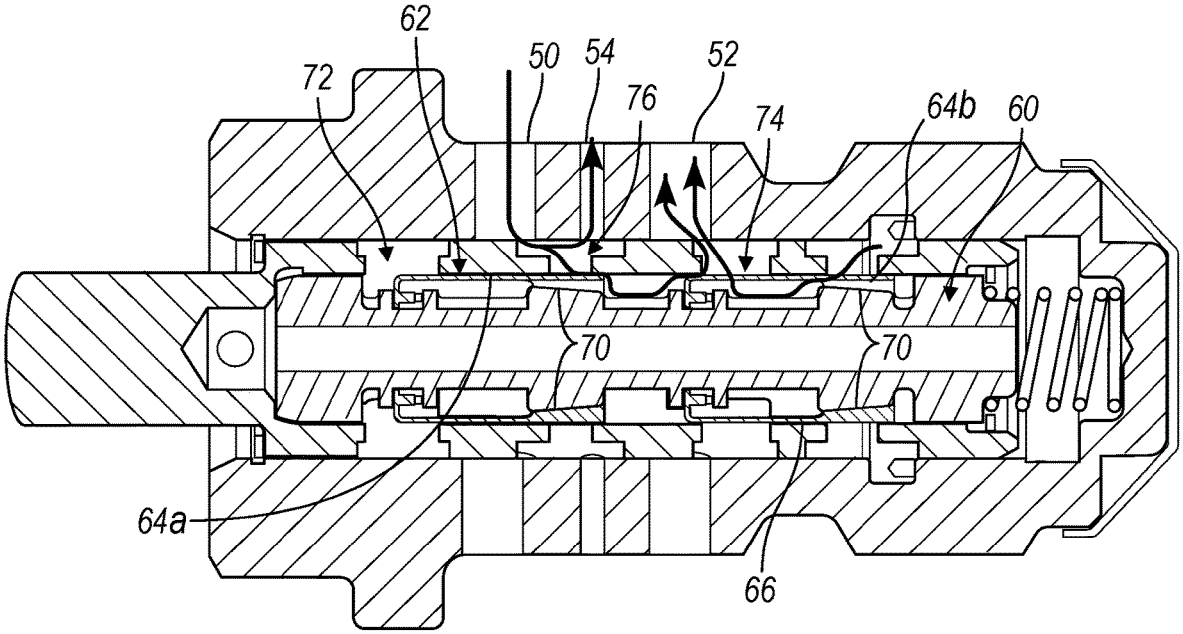
FIG. 1*b* is a cross-sectional view depicting a portion of an implementation of a hydraulically-actuated VCT system.

FIGS. 1*a* and 1*b* depict the system 10 positioning the spool 16 at a "fully withdrawn" position with respect to the sleeve 18. In this implementation, the fully withdrawn position of the spool 16 directs fluid from the advancing chamber 36 through the advancing port 50, the spool exhaust port 76, and first check valve 64*a* to the exhaust port 54. The hydraulic lock 44 can be in fluid communication with the advancing port 56 and the fluid leaving the advancing chamber 36 through the advancing fluid pathway 40 can decrease the force overcoming a biasing spring of the lock 44 thereby permitting the lock 44 to engage the stator housing 32 and prevent rotational movement between the rotor 26 and the stator housing 32. The exhaust port 54 fluidly communicates the fluid leaving the advancing chamber 36 to the tank 22. In addition, fluid leaving the advancing chamber 36 can pass through the first check valve 64*a*, the spool exhaust port 76, and the spool retarding port 74 entering the retarding chamber 38. Fluid from the fluid pump 20 passes through the second check valve 64*b* to the retarding port 52 to the retarding chamber 38.

Figure 2A:
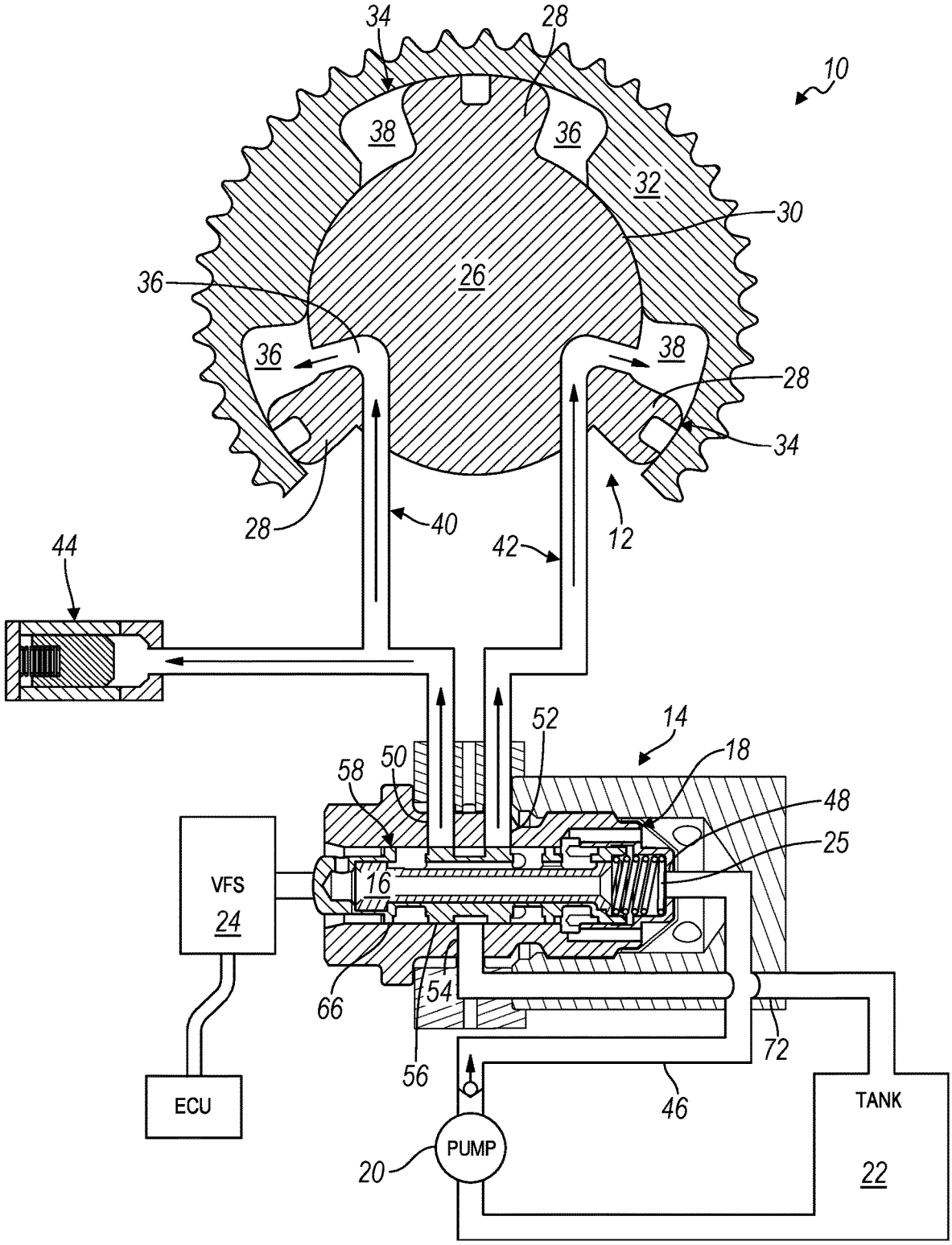
FIG. 2*a* is a schematic view depicting an implementation of a hydraulically-actuated variable camshaft timing (VCT) system.
Figure 2B:
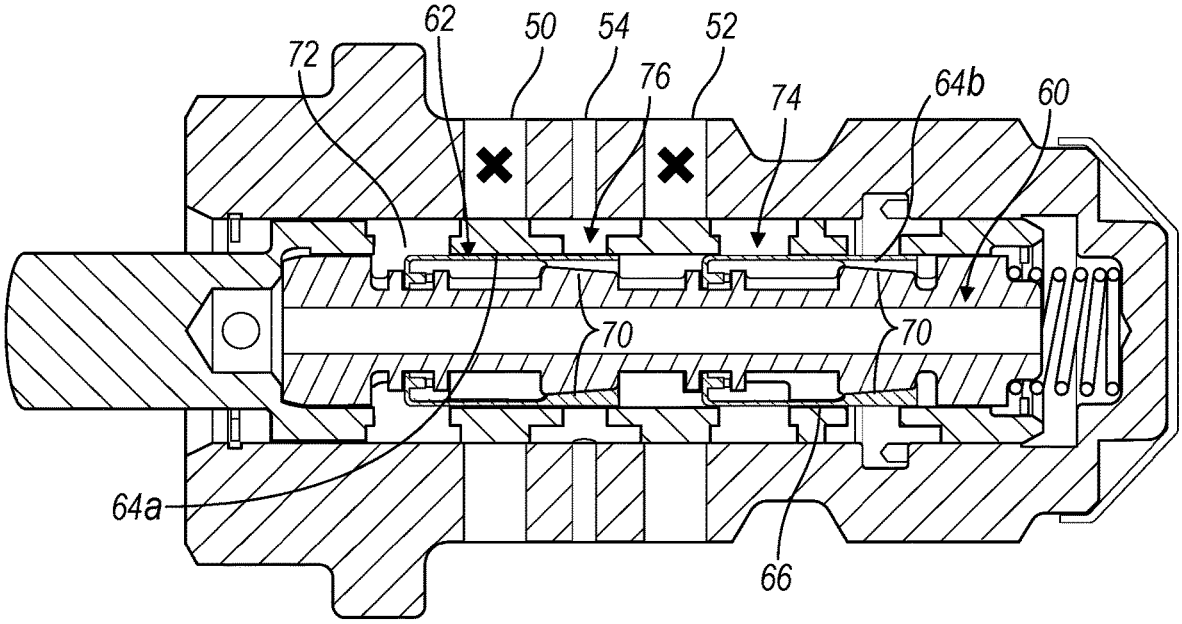
FIG. 2*b* is a cross-sectional view depicting a portion of an implementation of a hydraulically-actuated VCT system.
Figure 3A:
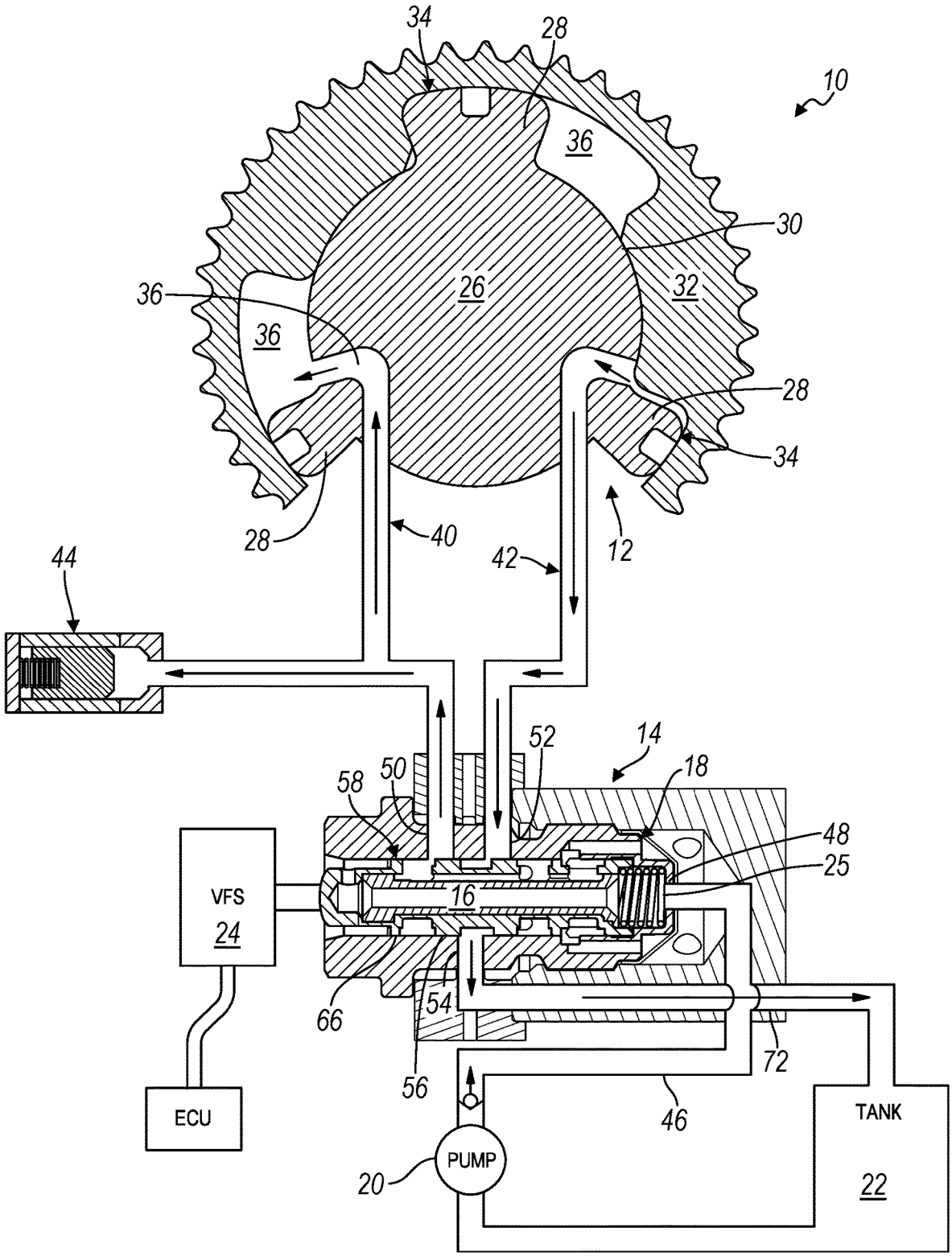
FIG. 3*a* is a schematic view depicting an implementation of a hydraulically-actuated variable camshaft timing (VCT) system.
Figure 3B:
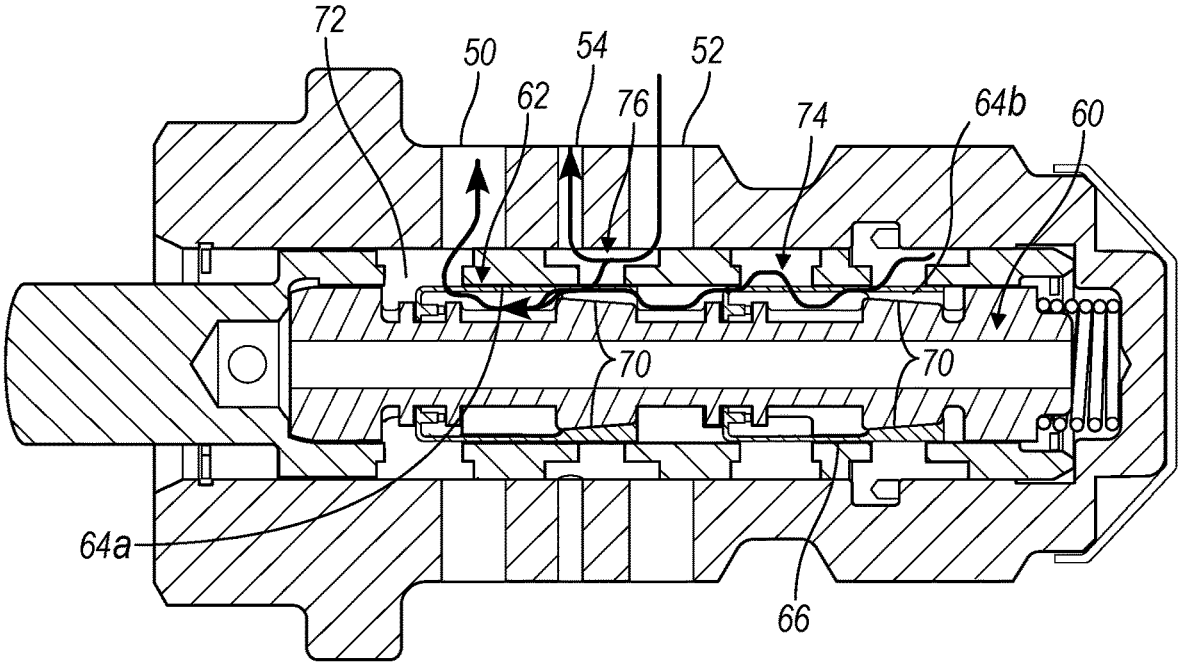
FIG. 3*b* is a cross-sectional view depicting a portion of an implementation of a hydraulically-actuated VCT system.

Turning to FIGS. 2*a* and 2*b*, the spool 16 can be moved to a "mid position" where the lands 58 prevent fluid from passing from the fluid supply port 48 to the advancing port 50 or the retarding port 52. The mid position also can prevent fluid from exiting either the advancing chamber 36 or the retarding chamber 38 thereby maintaining the angular position of the rotor 26 relative to the stator housing 32. FIGS. 3*a* and 3*b* depicts the system 10 positioning the spool 16 at a "fully inserted" position with respect to the sleeve 18. In this implementation, the fully inserted position of the spool 16 directs fluid from the fluid pump 20, passing through the second check valve 64*b*, through the advancing port 50 to the advancing chamber 36. The hydraulic lock 44 can receive the fluid, which may overcome the force of the spring of the lock 44 thereby releasing the lock 44 from the stator housing 32 permitting rotational movement between the rotor 26 and the housing 32. Fluid from the retarding chamber 38 exits through the retarding port 52 to the exhaust port 54. The exhaust port 54 fluidly communicates the fluid leaving the retarding chamber 38 to the tank 22. In addition, the fluid can flow from the retarding port 52 through the first check valve 64*a* into the advancing chamber 36 through the advancing port 50.

Figure 4:
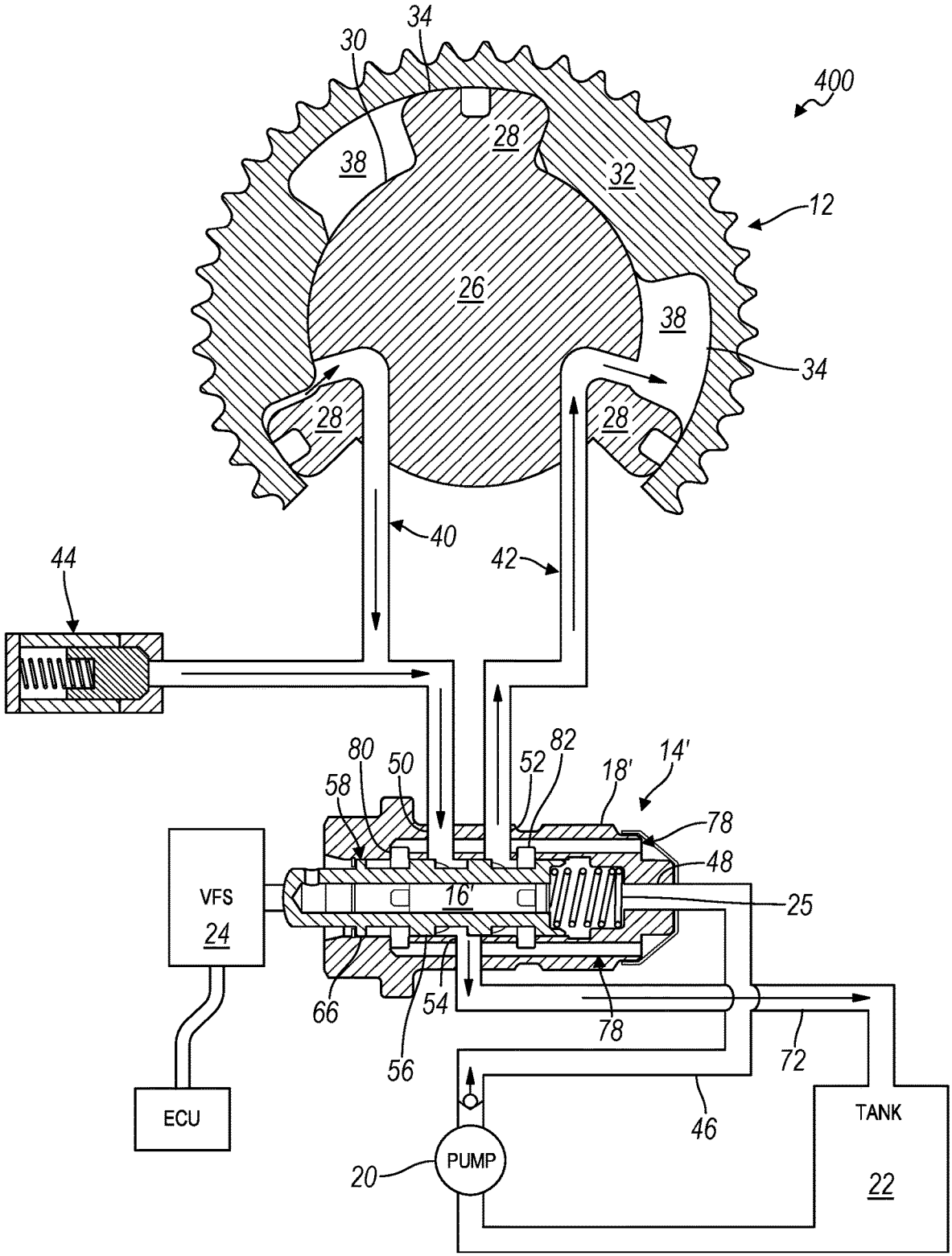
FIG. 4 is a schematic view depicting another implementation of a hydraulically-actuated VCT system.
Figure 5:
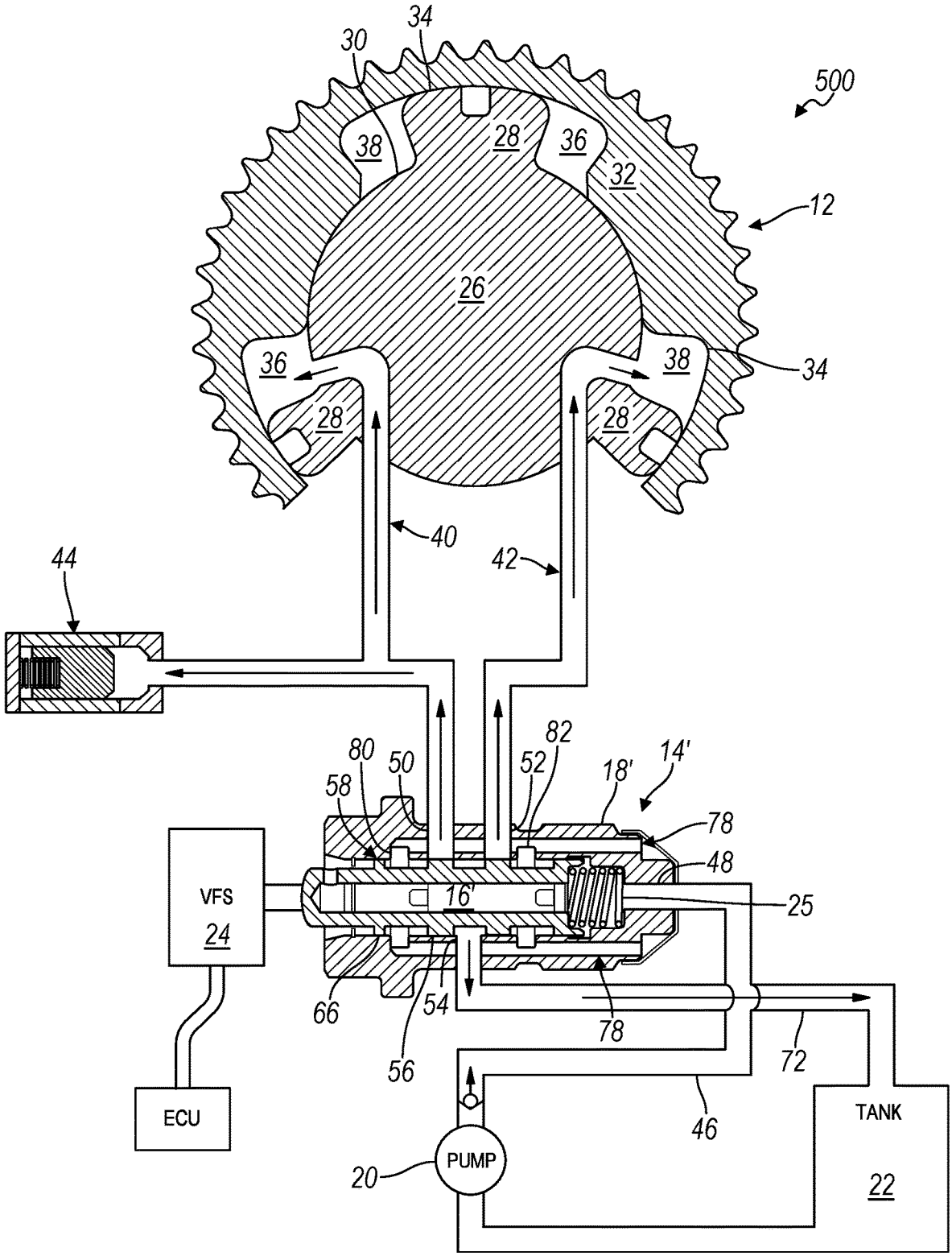
FIG. 5 is another schematic view depicting another implementation of a hydraulically-actuated VCT system.
Figure 6:
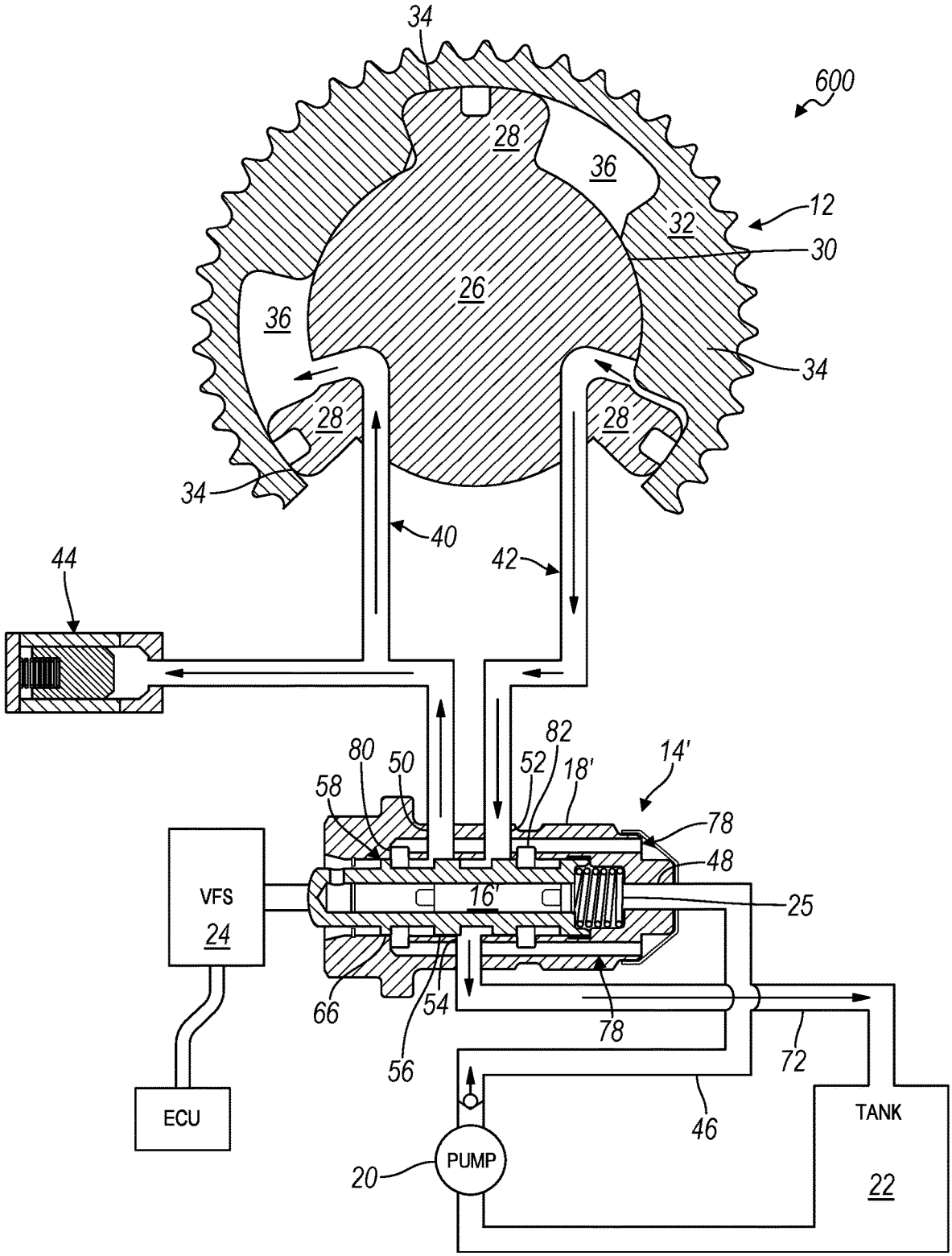
FIG. 6 is another schematic view depicting another implementation of a hydraulically-actuated VCT system.

Another implementation of the spool 16' and the sleeve or bolt 18' is shown in FIGS. 4-6. The sleeve 18' includes a sleeve fluid pathway 78 that is a fluid manifold extending axially within a wall of the sleeve 18' from the fluid supply 46 to a first fluid supply port 80 and a second fluid supply port 82 that provide fluid into the sleeve cavity 56. The exhaust port 54 can be positioned axially along the sleeve 18' in between the first fluid supply port 80 and the second fluid supply port 82. The exhaust port 54 can be located axially along the spool valve 14' in between the advancing port 50 and the retarding port 52. The exhaust port 54 can also, or alternatively, be located axially along the spool valve 14' in between the first fluid supply port 80 and the second fluid supply port 82. FIG. 4 depicts the system 10 positioning the spool 16' at a "fully withdrawn" position with respect to the sleeve 18' similar to what is described above with respect to FIGS. 1*a* and 1*b*. FIG. 5 depicts the spool 16 in a "mid position" where the lands 58 prevent fluid from passing from the fluid supply port 48 to the advancing port 50 or the retarding port 52. The mid position also can prevent fluid from exiting either the advancing chamber 36 or the retarding chamber 38 thereby maintaining the angular position of the rotor 26 relative to the stator housing 32. FIG. 6 depicts the system 10 positioning the spool 16' at a "fully inserted" position with respect to the sleeve 18' similar to what is described above with respect to FIGS. 3*a* and 3*b*.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. A hydraulically-actuated variable camshaft timing (VCT) system, comprising:

a spool valve including a unitary bolt and a spool, having a plurality of radially-outwardly extending lands, received within the bolt;

an advancing port formed by the bolt in fluid communication with an advancing chamber of a hydraulically-actuated camshaft phaser;

a retarding port formed by the bolt in fluid communication with a retarding chamber of the hydraulically-actuated camshaft phaser;

a first fluid supply port formed at least partially by the spool and by a spool plug received concentrically within the spool;

a second fluid supply port formed at least partially by the spool and by the spool plug; and an exhaust port formed by the bolt and axially positioned between the first fluid supply port and the second fluid supply port or between the advancing port and the retarding port, wherein the spool valve can direct fluid from: (a) the first fluid supply port and the second fluid supply port to the advancing port or the retarding port; (b) from one of the advancing port or the retarding port to the other of the advancing port or the retarding port; and (c) both (a) and (b) simultaneously depending on an axial position of the spool relative to the bolt such that a fluid pathway exists between the spool plug and a surface of a spool cavity, defined at least partially by an interior surface of the bolt, confronting the spool plug.

2. The hydraulically-actuated VCT system recited in claim 1, wherein the hydraulically-actuated VCT system directs fluid from the advancing chamber to the retarding chamber or from the retarding chamber to the advancing chamber.

3. The hydraulically-actuated VCT system recited in claim 1, further comprising one or more check valves.

4. The hydraulically-actuated VCT system recited in claim 1, wherein the exhaust port is in fluid communication with an inner surface of a rotor.

5. The hydraulically-actuated VCT system recited in claim 1, wherein a fluid supply port of the first fluid supply port or the second fluid supply port is positioned at an axial end of the bolt.

6. A hydraulically-actuated variable camshaft timing (VCT) system, comprising:

a spool valve configured to receive fluid from a fluid supply that includes a spool, having a plurality of radially-outwardly extending lands, and a spool cavity, received within a unitary bolt;

an advancing port in the bolt in fluid communication with an advancing chamber of a hydraulically-actuated camshaft phaser;

a retarding port in the bolt in fluid communication with a retarding chamber of the hydraulically-actuated camshaft phaser;

a first fluid supply port formed in the bolt;

a second fluid supply port formed in the bolt;

a fluid pathway formed in the unitary bolt and extending axially within an outer wall of the bolt and an inner wall of the bolt, from the fluid supply to the first fluid supply port and the second fluid supply port;

an exhaust port axially positioned in the bolt between the first fluid supply port and the second fluid supply port or between the advancing port and the retarding port, wherein the fluid pathway is a fluid manifold, wherein the exhaust port is configured to selectively receive fluid from the advancing chamber and the retarding chamber depending on an axial position of the spool relative to the bolt, and wherein the spool valve directs fluid from the fluid supply to the advancing chamber, the spool valve directs fluid from the fluid supply to the retarding chamber, and the spool valve directs fluid from one of the advancing chamber or the retarding chamber to the other of the advancing chamber or retarding chamber.

7. The hydraulically-actuated VCT system recited in claim 6, further comprising one or more check valves.

8. The hydraulically-actuated VCT system recited in claim 6, wherein the exhaust port is in fluid communication with an inner surface of a rotor.

9. The hydraulically-actuated VCT system recited in claim 6, wherein a fluid supply port of the first supply port and the second fluid supply port is positioned at an axial end of the bolt.

* * * * *